US008840370B2

(12) United States Patent
Walunj et al.

(10) Patent No.: US 8,840,370 B2
(45) Date of Patent: Sep. 23, 2014

(54) BUCKET ASSEMBLY FOR TURBINE SYSTEM

(75) Inventors: Jalindar Appa Walunj, Bangalore (IN); Mark Steven Honkomp, Taylors, SC (US)

(73) Assignee: General Electric Company, Schenectady, NY (US)

( * ) Notice: Subject to any disclaimer, the term of this patent is extended or adjusted under 35 U.S.C. 154(b) by 474 days.

(21) Appl. No.: 13/289,110

(22) Filed: Nov. 4, 2011

(65) Prior Publication Data

US 2013/0115102 A1 May 9, 2013

(51) Int. Cl.
*F01D 5/18* (2006.01)

(52) U.S. Cl.
CPC ..... *F01D 58/186* (2013.01); *F01D 5/187* (2013.01)
USPC ..... 416/96 R; 416/193 A

(58) Field of Classification Search
CPC ..... F01D 5/186; F01D 5/187; F01D 5/18; F05D 2260/201; F05D 2260/202
USPC ..... 416/96 R, 97 R, 193 A
See application file for complete search history.

(56) References Cited

U.S. PATENT DOCUMENTS

| | | | |
|---|---|---|---|
| 4,017,213 | A | 4/1977 | Przirembel |
| 4,738,587 | A | 4/1988 | Kildea |
| 4,767,260 | A | 8/1988 | Clevenger et al. |
| 5,098,257 | A | 3/1992 | Hulgren et al. |
| 5,120,192 | A | 6/1992 | Ohtomo et al. |
| 5,197,852 | A | 3/1993 | Walker et al. |
| 5,340,278 | A | 8/1994 | Magowan |
| 5,344,283 | A | 9/1994 | Magowan et al. |
| 5,382,135 | A | 1/1995 | Green |
| 5,413,458 | A | 5/1995 | Calderbank |
| 5,591,002 | A | 1/1997 | Cunha et al. |
| 5,609,466 | A | 3/1997 | North et al. |
| 5,634,766 | A | 6/1997 | Cunha et al. |
| 5,639,216 | A | 6/1997 | McLaurin et al. |
| 5,660,524 | A | 8/1997 | Lee et al. |
| 5,700,131 | A | 12/1997 | Hall et al. |
| 5,738,489 | A | 4/1998 | Lee |

(Continued)

FOREIGN PATENT DOCUMENTS

| | | |
|---|---|---|
| EP | 0866214 | 9/1998 |
| EP | 2037081 A1 | 3/2009 |
| EP | 2228518 A2 | 9/2010 |
| EP | 2365187 A2 | 9/2011 |

OTHER PUBLICATIONS

Search Report and Written Opinion from EP Application No. 12191001.2 dated May 2, 2013.

*Primary Examiner* — Dwayne J White
(74) *Attorney, Agent, or Firm* — Dority & Manning, P.A.

(57) ABSTRACT

A bucket assembly for a turbine system is disclosed. The bucket assembly includes a main body having an exterior surface and defining a main cooling circuit, and a platform surrounding the main body and at least partially defining a platform cooling circuit. The platform includes a forward portion and an aft portion each extending between a pressure side slash face and a suction side slash face. The platform further includes a forward face, an aft face, and a top face. The bucket assembly further includes a passage defined in the platform generally between the platform cooling circuit and the pressure side slash face and in fluid communication with one of the main cooling circuit or the platform cooling circuit.

20 Claims, 4 Drawing Sheets

(56) References Cited

U.S. PATENT DOCUMENTS

| | | | |
|---|---|---|---|
| 5,743,708 | A | 4/1998 | Cunha et al. |
| 5,762,471 | A | 6/1998 | Cunha |
| 5,772,398 | A | 6/1998 | Noiret et al. |
| 5,816,835 | A | 10/1998 | Meszaros |
| 5,848,876 | A | 12/1998 | Tomita |
| 5,964,575 | A | 10/1999 | Marey |
| 5,993,155 | A | 11/1999 | Endres et al. |
| 6,017,189 | A | 1/2000 | Judet et al. |
| 6,019,579 | A | 2/2000 | Fukuno et al. |
| 6,033,181 | A | 3/2000 | Endres et al. |
| 6,036,436 | A | 3/2000 | Fukuno et al. |
| 6,036,441 | A | 3/2000 | Manning et al. |
| 6,071,075 | A | 6/2000 | Tomita et al. |
| 6,082,961 | A | 7/2000 | Anderson et al. |
| 6,089,822 | A | 7/2000 | Fukuno |
| 6,120,249 | A | 9/2000 | Hultgren et al. |
| 6,126,396 | A | 10/2000 | Daughty et al. |
| 6,132,173 | A | 10/2000 | Tomita et al. |
| 6,168,381 | B1 | 1/2001 | Reddy |
| 6,174,134 | B1 | 1/2001 | Lee et al. |
| 6,179,565 | B1 | 1/2001 | Palumbo et al. |
| 6,190,130 | B1 | 2/2001 | Fukue et al. |
| 6,196,799 | B1 | 3/2001 | Fukue et al. |
| 6,206,638 | B1 | 3/2001 | Glynn et al. |
| 6,210,111 | B1 | 4/2001 | Liang |
| 6,220,817 | B1 | 4/2001 | Durgin et al. |
| 6,241,467 | B1 | 6/2001 | Zelesky et al. |
| 6,283,708 | B1 | 9/2001 | Zelesky |
| 6,290,463 | B1 | 9/2001 | Fargher et al. |
| 6,309,175 | B1 | 10/2001 | Hahnle et al. |
| 6,331,096 | B1 | 12/2001 | Burdgick et al. |
| 6,341,939 | B1 | 1/2002 | Lee |
| 6,402,471 | B1 | 6/2002 | Demers et al. |
| 6,431,833 | B2 | 8/2002 | Jones |
| 6,435,813 | B1 | 8/2002 | Rieck, Jr. et al. |
| 6,457,935 | B1 | 10/2002 | Antunes et al. |
| 6,468,031 | B1 | 10/2002 | Yu et al. |
| 6,478,540 | B2 | 11/2002 | Abuaf et al. |
| 6,481,967 | B2 | 11/2002 | Tomita et al. |
| 6,506,020 | B2 | 1/2003 | Dailey |
| 6,508,620 | B2 | 1/2003 | Sreekanth et al. |
| 6,517,312 | B1 | 2/2003 | Jones et al. |
| 6,543,993 | B2 | 4/2003 | Burdgick et al. |
| 6,595,748 | B2 | 7/2003 | Flodman et al. |
| 6,647,624 | B2 | 11/2003 | Fried et al. |
| 6,705,836 | B2 | 3/2004 | Bourriaud et al. |
| 6,783,323 | B2 * | 8/2004 | Shiozaki et al. ..... 415/115 |
| 6,811,373 | B2 | 11/2004 | Tomita et al. |
| 6,832,889 | B1 | 12/2004 | Lee et al. |
| 6,832,893 | B2 | 12/2004 | Chevrefils et al. |
| 6,887,033 | B1 | 5/2005 | Phillips et al. |
| 6,945,749 | B2 | 9/2005 | De Cardenas |
| 6,945,750 | B2 | 9/2005 | Benedetti et al. |
| 7,001,141 | B2 | 2/2006 | Cervenka |
| 7,004,720 | B2 | 2/2006 | Synnott et al. |
| 7,056,083 | B2 | 6/2006 | Gray |
| 7,063,506 | B2 | 6/2006 | Davison et al. |
| 7,097,424 | B2 | 8/2006 | Cunha et al. |
| 7,097,426 | B2 | 8/2006 | Lee et al. |
| 7,131,817 | B2 | 11/2006 | Keith et al. |
| 7,137,779 | B2 | 11/2006 | Liang |
| 7,144,215 | B2 | 12/2006 | Keith et al. |
| 7,147,439 | B2 | 12/2006 | Jacala et al. |
| 7,182,576 | B2 | 2/2007 | Bunker et al. |
| 7,186,089 | B2 | 3/2007 | Liang |
| 7,195,458 | B2 | 3/2007 | Liang |
| 7,198,467 | B2 | 4/2007 | Keith et al. |
| 7,220,103 | B2 | 5/2007 | Cunha et al. |
| 7,249,933 | B2 | 7/2007 | Lee et al. |
| 7,255,536 | B2 | 8/2007 | Cunha et al. |
| 7,309,212 | B2 | 12/2007 | Itzel et al. |
| 7,322,797 | B2 | 1/2008 | Lee et al. |
| 7,374,400 | B2 | 5/2008 | Boswell |
| 7,416,390 | B2 | 8/2008 | Liang |
| 7,416,391 | B2 | 8/2008 | Veltre et al. |
| 7,452,184 | B2 | 11/2008 | Durocher et al. |
| 7,497,661 | B2 | 3/2009 | Boury et al. |
| 7,600,972 | B2 | 10/2009 | Benjamin et al. |
| 7,695,246 | B2 * | 4/2010 | Cunha et al. ..... 416/97 R |
| 7,713,029 | B1 | 5/2010 | Davies |
| 2002/0172590 | A1 | 11/2002 | Sreekanth et al. |
| 2004/0001753 | A1 | 1/2004 | Tiemann |
| 2005/0265840 | A1 | 12/2005 | Levine et al. |
| 2006/0056968 | A1 | 3/2006 | Jacala et al. |
| 2006/0222493 | A1 | 10/2006 | Liang |
| 2006/0222494 | A1 | 10/2006 | Liang |
| 2006/0222495 | A1 | 10/2006 | Laing |
| 2007/0189896 | A1 | 8/2007 | Itzel |
| 2008/0050223 | A1 | 2/2008 | Liang |
| 2008/0085190 | A1 | 4/2008 | Liang |
| 2009/0060712 | A1 | 3/2009 | De Cardenas |

* cited by examiner

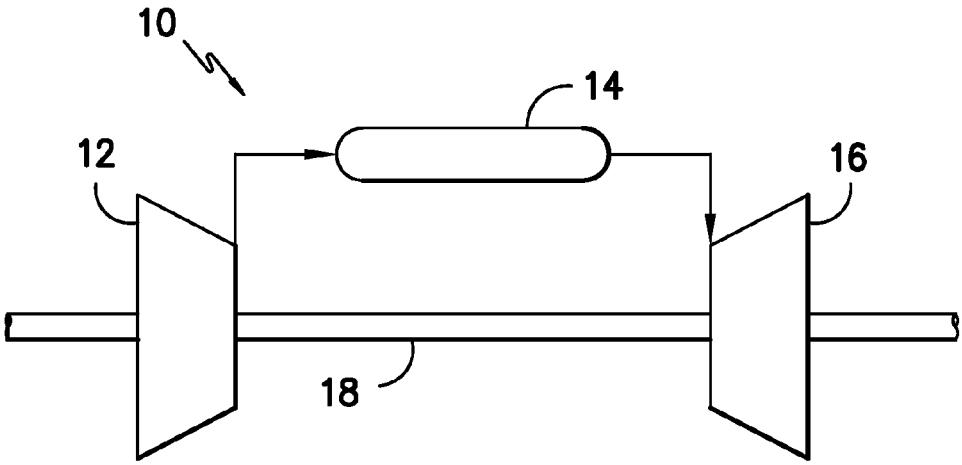
FIG. –1–
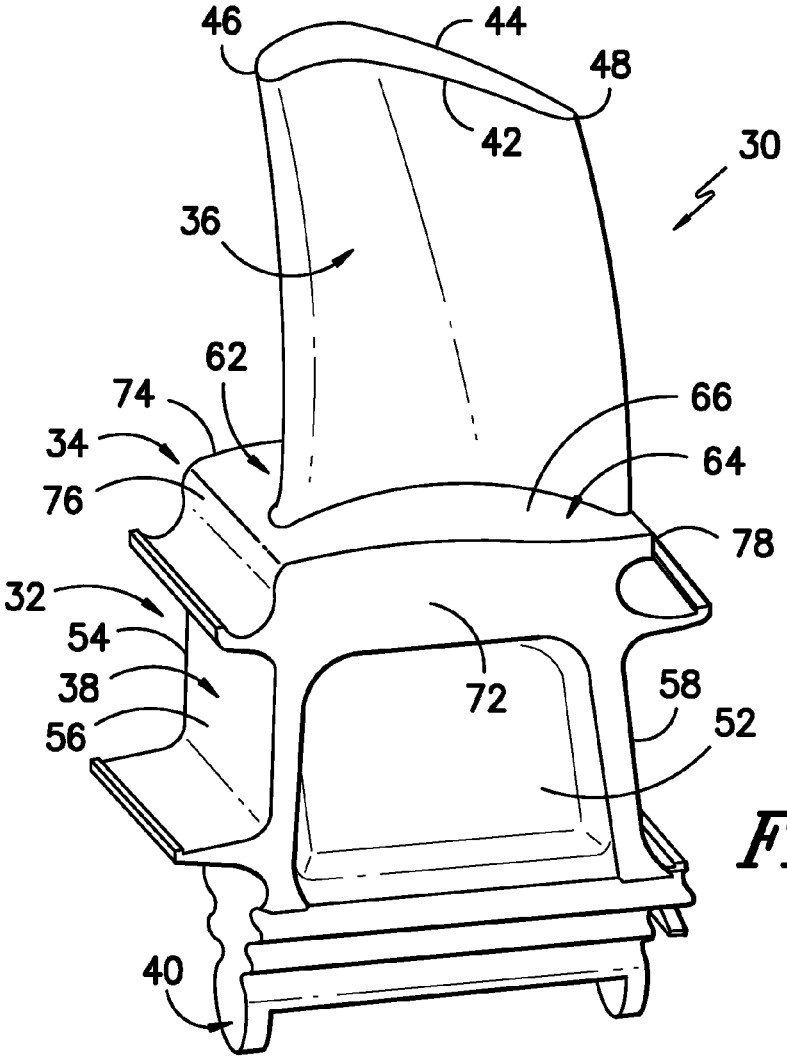
FIG. –2–

FIG. —4—

BUCKET ASSEMBLY FOR TURBINE SYSTEM

FIELD OF THE INVENTION

The subject matter disclosed herein relates generally to turbine systems, and more specifically to bucket assemblies for turbine systems.

BACKGROUND OF THE INVENTION

Turbine systems are widely utilized in fields such as power generation. For example, a conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

Various strategies are known in the art for cooling various gas turbine system components. For example, a cooling medium may be routed from the compressor and provided to various components. In the compressor and turbine sections of the system, the cooling medium may be utilized to cool various compressor and turbine components.

Buckets are one example of a hot gas path component that must be cooled. For example, various parts of the bucket, such as the airfoil, the platform, the shank, and the dovetail, are disposed in a hot gas path and exposed to relatively high temperatures, and thus require cooling. Various cooling passages and cooling circuits may be defined in the various parts of the bucket, and cooling medium may be flowed through the various cooling passages and cooling circuits to cool the bucket.

In many known buckets, however, various portions of the buckets may reach higher than desired temperatures during operation despite the use of such cooling passages and cooling circuits. For example, despite the use of such cooling passages and cooling circuits in the platforms of known buckets, various portions of the buckets may reach higher than desired temperatures. One specific portion that is of concern in known buckets is the pressure side slash face. Despite the use of known cooling circuits, such as a platform cooling circuit, in platforms, cooling of the pressure side slash face may currently be inadequate.

Accordingly, an improved bucket assembly for a turbine system is desired in the art. Specifically, a bucket assembly with improved cooling features would be advantageous.

BRIEF DESCRIPTION OF THE INVENTION

Aspects and advantages of the invention will be set forth in part in the following description, or may be obvious from the description, or may be learned through practice of the invention.

In one embodiment, a bucket assembly for a turbine system is disclosed. The bucket assembly includes a main body having an exterior surface and defining a main cooling circuit, and a platform surrounding the main body and at least partially defining a platform cooling circuit. The platform includes a forward portion and an aft portion each extending between a pressure side slash face and a suction side slash face. The platform further includes a forward face, an aft face, and a top face. The bucket assembly further includes a passage defined in the platform generally between the platform cooling circuit and the pressure side slash face and in fluid communication with one of the main cooling circuit or the platform cooling circuit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system according to one embodiment of the present disclosure;

FIG. 2 is a perspective view of a bucket assembly according to one embodiment of the present disclosure;

DETAILED DESCRIPTION OF THE INVENTION

Figure 3:
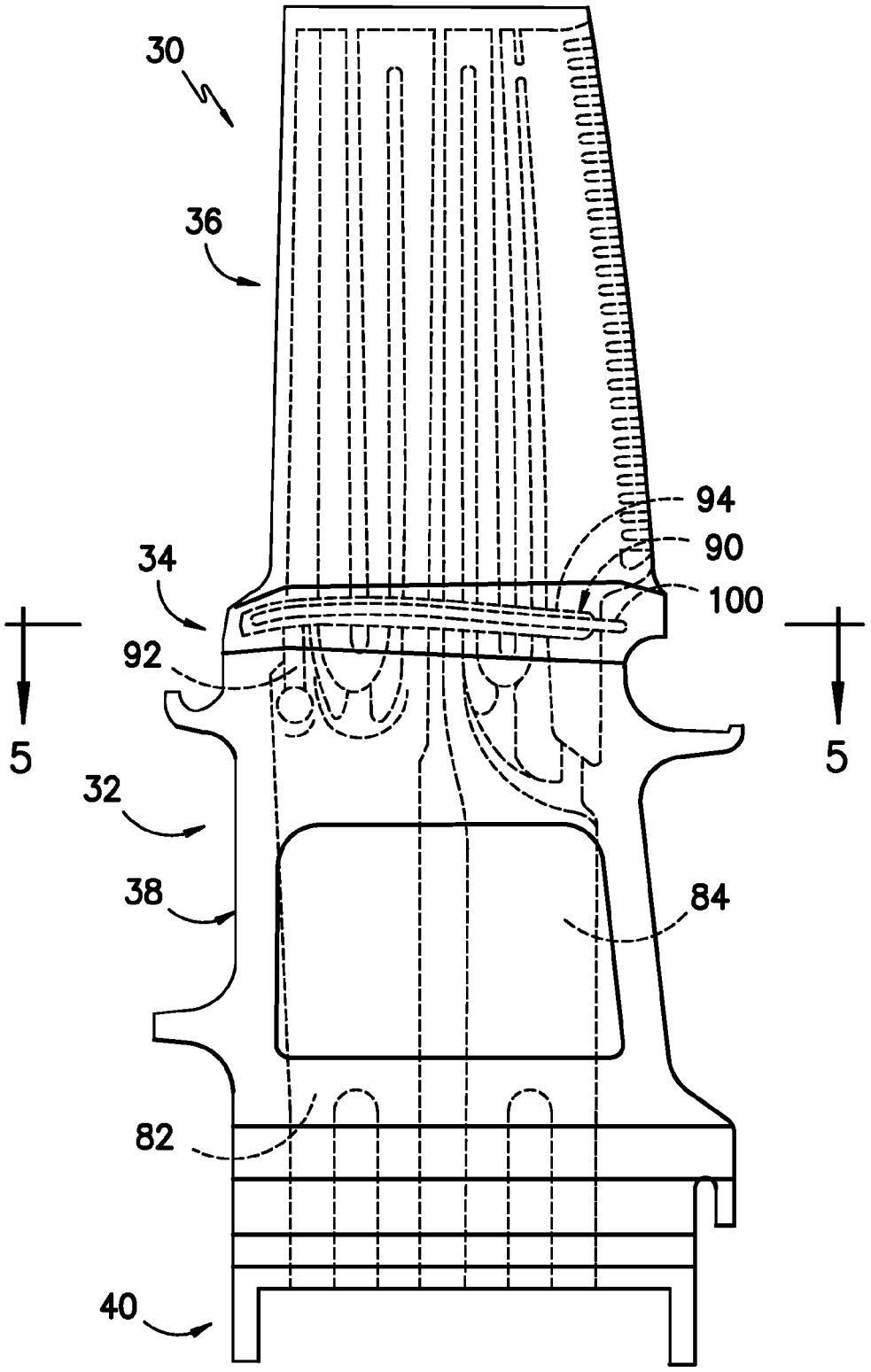
FIG. 3 is a front view illustrating the internal components of a bucket assembly according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages. A first stage of the turbine 16 may include a plurality of circumferentially spaced nozzles and buckets. The nozzles may be disposed and fixed circumferentially about the shaft 18. The buckets may be disposed circumferentially about the shaft and coupled to the shaft 18. A second stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. A third stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. The various stages of the turbine 16 may be at least partially disposed in the turbine 16 in, and may at least partially define, a hot gas path (not shown). It should be understood that the turbine 16 is not limited to three stages, but rather that any number of stages are within the scope and spirit of the present disclosure.

Similarly, the compressor 12 may include a plurality of compressor stages (not shown). Each of the compressor 12 stages may include a plurality of circumferentially spaced nozzles and buckets.

One or more of the buckets in the turbine 16 and/or the compressor 12 may comprise a bucket assembly 30, as shown in FIGS. 2 through 5. The bucket assembly 30 may include a main body 32 and a platform 34. The main body 32 typically includes an airfoil 36 and a shank 38. The airfoil 36 may be positioned radially outward from the shank 38. The shank 38 may include a root 40, which may attach to a rotor wheel (not shown) in the turbine system 10 to facilitate rotation of the bucket assembly 30.

In general, the main body 32 has an exterior surface. In embodiments wherein the main body 32 includes an airfoil 36 and shank 38, for example, the portion of the exterior surface defining the airfoil 36 may have a generally aerodynamic contour. For example, the airfoil 32 may have an exterior surface defining a pressure side 42 and suction side 44 each extending between a leading edge 46 and a trailing edge 48. Further, the portion of the exterior surface of the shank 38 may include a pressure side face 52, a suction side face 54, a leading edge face 56, and a trailing edge face 58.

The platform 34 may generally surround the main body 32, as shown. A typical platform may be positioned at an intersection or transition between the airfoil 36 and shank 38 of the main body 32, and extend outwardly in the generally axial and tangential directions. It should be understood, however, that a platform according to the present disclosure may have any suitable position relative to the main body 32 of the bucket assembly 30.

A platform 34 according to the present disclosure may include a forward portion 62 and an aft portion 64. The forward portion 62 is that portion of the platform 34 positioned proximate the leading edge 46 of the airfoil 36 and the leading edge face 56 of the shank 38, while the aft portion 64 is that portion of the platform 34 positioned proximate the trailing edge 48 of the airfoil 36 and the trailing edge 58 of the shank 36. The forward portion 62 and the aft portion 64 may further define a top face 66 of the platform 34, which may generally surround the airfoil 36 as shown. Further, a peripheral edge may surround the forward portion 62, aft portion 64, and top face 66. The peripheral edge may include a pressure side slash face 72 and suction side slash face 74, which each of the forward portion 62 and the aft portion 64 may extend between. The peripheral edge may further include a forward face 76, which may define a peripheral edge of the forward portion 62, and an aft face 78, which may define a peripheral edge of the aft portion 64.

Figure 4:
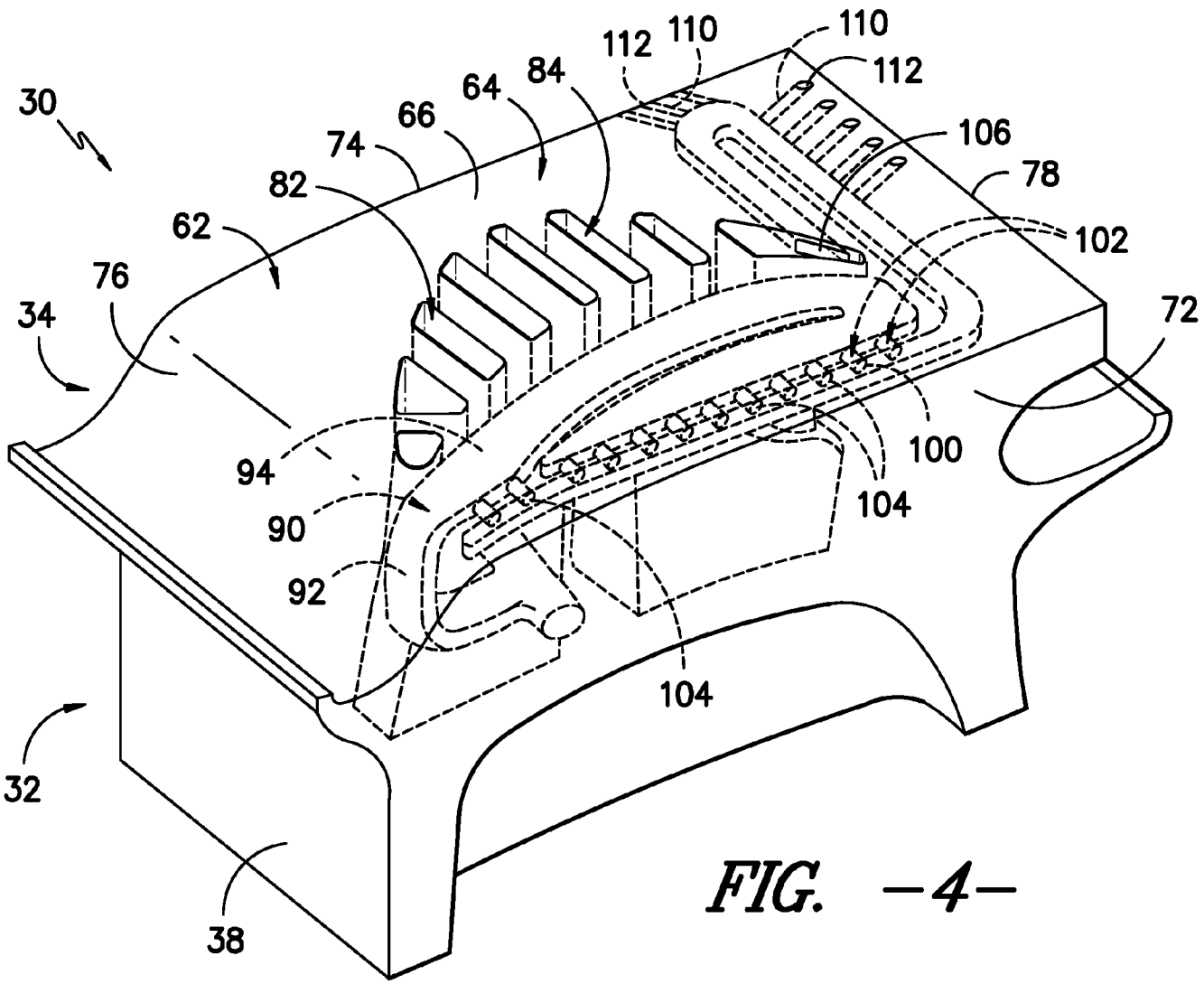
FIG. 4 is a partial perspective view illustrating various internal components of a bucket assembly according to one embodiment of the present disclosure.
Figure 5:
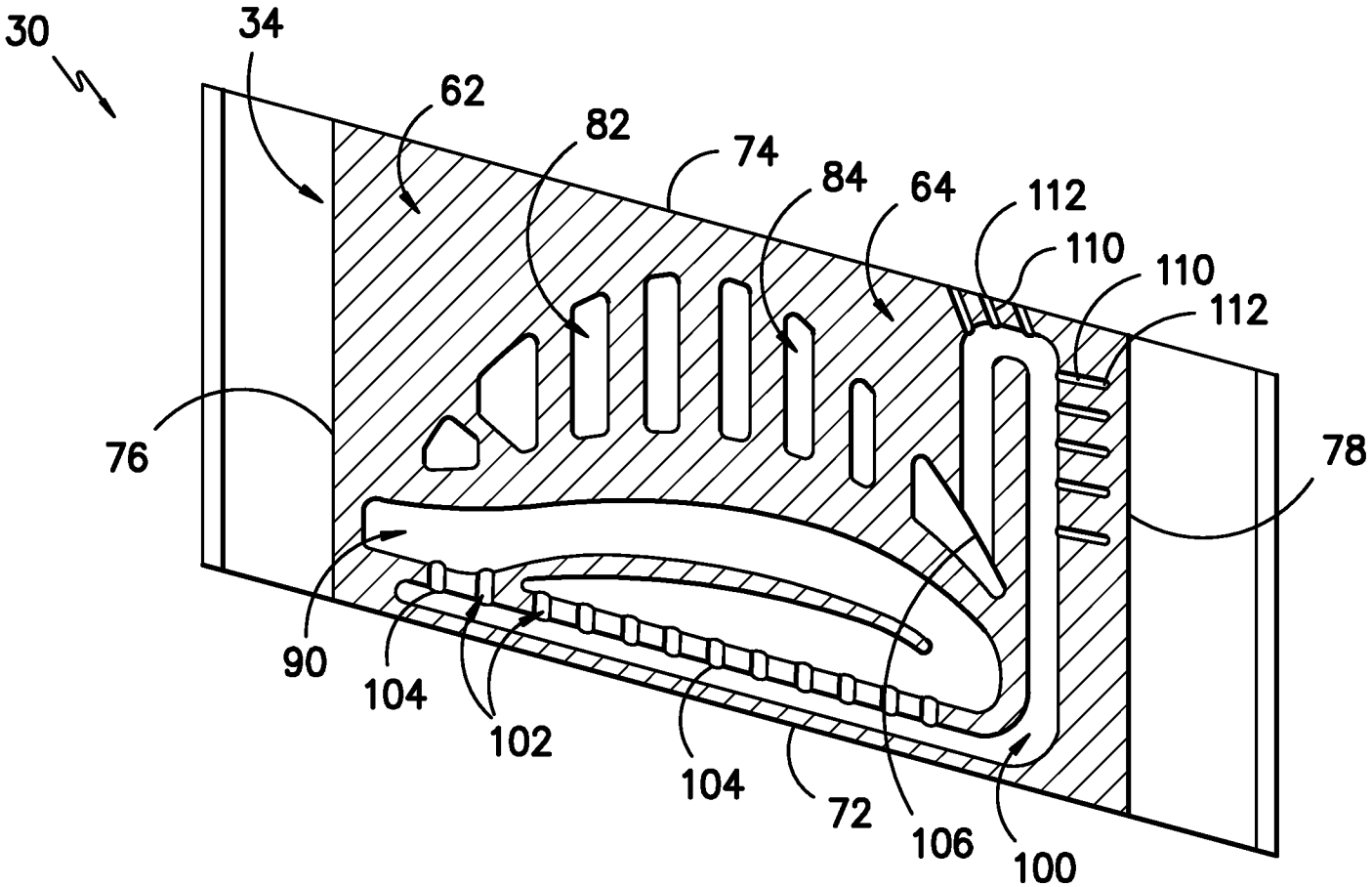
FIG. 5 is a top view illustrating various internal components of a bucket assembly according to one embodiment of the present disclosure.

As shown in FIGS. 3 through 5, the main body 32 may define one or more main cooling circuits therein. The main cooling circuits may extend through portions of the main body 32 to cool the main body 32. For example, in some embodiments as shown, the main body 32 may define a forward main cooling circuit 82 and an aft main cooling circuit 84. The main cooling circuits may have any suitable shape and may extend along any suitable path. For example, as shown each main cooling circuit may have various branches and serpentine portions and may extend through the various portions of the main body 32, such as through the airfoil 36 and shank 38. A cooling medium may be flowed into and through the various main cooling circuits 82 to cool the main body 32.

As further shown in FIGS. 3 through 5, one or more platform cooling circuits 90 may be defined in the bucket assembly 30. In general, the platform cooling circuit 90 may be defined at least partially in the platform 34. For example, in exemplary embodiments, a portion of the platform cooling circuit 90 is defined in the platform 34, and extends through the platform 34 to cool it. Other portions of the platform cooling circuit 90 may extend into the main body 32 to inlet cooling medium into the platform cooling circuit 90 or exhaust the cooling medium therefrom. In one embodiment, as shown in FIG. 3, a platform cooling circuit 90 may include an inlet portion 92, an intermediate portion 94, and an outlet portion 96. The inlet portion 92 and outlet portion 96 may extend from the platform 34 into the main body 32, and the intermediate portion 94 may extend through the platform 34. Cooling medium may flow into the platform cooling circuit 90 through the inlet portion 92, flow through intermediate portion 94, and be exhausted through the outlet portion 96.

In many bucket assemblies 30, a platform cooling circuit 90 is in fluid communication with a main cooling circuit, such that cooling medium is flowed from a main cooling circuit into the platform cooling circuit 90 and/or is flowed from a platform cooling circuit 90 to a main cooling circuit. For example, in the embodiment shown in FIGS. 3 through 5, the inlet portion 92 of the platform cooling circuit 90 may be in fluid communication with the forward main cooling circuit 82, while the outlet portion 96 is in fluid communication with the aft main cooling circuit 84.

A bucket assembly 30 according to the present disclosure may further advantageously include one or more passages 100, as shown in FIGS. 3 through 5. A passage 100 according to the present disclosure is defined in the platform 34, and is in fluid communication with one or more of a main cooling circuit and/or a platform cooling circuit 90. Further, a passage 100 is positioned generally between a platform cooling circuit 90 and the pressure side slash face 72. The inclusion of such passages 100 adjacent to the pressure side slash faces 72 of platforms 34 may advantageously cool such faces 72 and portions of the platforms 34 proximate such faces 72, thus preventing the faces 72 and proximate portions from reaching higher than desired temperatures during operation of a turbine system 10.

As shown in FIGS. 3 through 5, a passage 100 according to the present disclosure may further extend through other portions of a platform 34. For example, a passage 100 may further extend through the forward portion 62 and/or aft portion 64 of the platform 34. For example, as shown in FIGS. 3 through 5, a passage 100 may further extend through the aft portion 64 adjacent to, and optionally parallel to, the aft face 78 and/or suction side slash face 74 or any portions thereof.

A passage 100 according to the present disclosure may have any suitable size, shape, and/or path. For example, in some embodiments, a passage 100 may have a generally circular cross-sectional profile. In other embodiments, however, a passage 100 may have an oval, rectangular, triangular, or other suitable polygonal cross-sectional profile. Further, a passage 100 according to the present disclosure may have a generally linear path, or may have a generally curvilinear path or other suitable path. For example, as shown, a passage 100 may have a generally serpentine path. Further, it should be understood that the size, shape, and/or path of a passage 100 according to the present disclosure may be constant throughout the passage 100, or may change through the passage 100 or any portion thereof.

In some embodiments as shown, a passage 100 may extend generally parallel to the pressure side slash face 72. Alternatively, however, a passage 100 or any portion thereof may extend at any suitable angle to the pressure side slash face 72. Further, a passage according to the present disclosure may extend through all or any portion of the forward portion 62 and/or the aft portion 64 of the platform 34.

In exemplary embodiments, as shown, a bucket assembly 30 according to the present disclosure may further include one or more impingement passages 102. Each impingement passage 102 may extend between a passage 100 and one of a main cooling circuit or a platform cooling circuit 70. Such impingement passages 102 provide fluid communication between the one of the main cooling circuit or platform cooling circuit 70 and a passage 100. Thus, cooling medium that flows through an impingement passage 102 may impinge on a surface of a passage 100, providing impingement cooling to the pressure side slash face 72. Such impingement cooling may facilitate further cooling of the pressure side slash face 72 and proximate portions of the platform 34.

As mentioned above, a passage 100 according to the present disclosure may be in fluid communication with one or more of a main cooling circuit and/or a platform cooling circuit 90. In exemplary embodiments, a passage 100 may be in fluid communication with both a main cooling circuit and a platform cooling circuit 90. For example, as shown in FIGS. 3 through 5, a passage 100 may include one or more inlets 104 and one or more outlets 106. The inlets 104 and outlets 106 may be in fluid communication with a main cooling circuit and a platform cooling circuit 90. FIGS. 3 through 5 illustrate, for example, a plurality of inlets 104 in fluid communication with a platform cooling circuit 90. The inlets 104 may be directly connected to impingement passages 102, which are connected to a passage 100 and provide impingement cooling as discussed above, or may be directly connected to the passage 100 itself. The outlets 106 may be directly connected to a main cooling circuit, such as to aft main cooling circuit 84. Thus cooling medium may flow from a platform cooling circuit 90 through an inlet 104 into a passage 100, such as through an impingement passage 102. The cooling medium may then flow through the passage 100, and may be exhausted from the cooling passage 100 through an outlet 106 into a main cooling circuit, such as aft main cooling circuit 84.

Alternatively, however, a passage 100 according to the present disclosure need not be in fluid communication with both a main cooling circuit and a platform cooling circuit 90. For example, in some embodiments, a passage 100, such as an inlet 104 thereof, may be in fluid communication with a platform cooling circuit 90. An outlet 106 of the passage 100, however, may be defined in a surface of the platform 34, such as in the top face 66, pressure side slash face 72, suction side slash face 74, forward face 76, or aft face 78. Cooling medium flowed through the passage 100 may thus be exhausted external to the bucket 30.

Notably, in exemplary embodiments, cooling medium flows from the platform cooling circuit 90 into the passage 100. This may be particularly advantageous, because the cooling efficiency of the cooling medium may be increased. Cooling medium may be flowed into the platform cooling circuit 90 from a main cooling circuit to cool the platform cooling circuit 90. By then flowing such cooling medium into a passage 100, the cooling properties of the cooling medium may be stretched, thus increasing the efficiency of the cooling medium before it is exhausted from the bucket assembly 30.

In some embodiments, a bucket assembly 30 according to the present disclosure may further include one or more exhaust passages 110. Each exhaust passage 110 may be defined in the platform 34, such as in the aft portion 64 of the platform 34 as shown and/or in the forward portion 62 of the platform 34, and may be in fluid communication with a passage 100. Thus, cooling medium flowing through a passage 100 may flow from the passage 100 into an exhaust passage 110.

Each exhaust passage 110 may further include an outlet 112. The outlet 112 may be defined in any suitable location on the platform 34, such as on the aft portion 64 and/or forward portion 62 of the platform 34. For example, an outlet 112 may be defined in the top face 66 as shown, or in the suction side slash face 74 as shown, or in the pressure side slash face 72, forward face 76, aft face 78, or any other suitable location on the platform 34, such as on the aft portion 64 and/or forward portion 62 of the platform 34. Cooling medium 100 flowed through an exhaust passage 110 may thus be exhausted through the outlet 112 of that exhaust passage 110. Additionally, in some embodiments, such exhausted cooling medium may further advantageously act as a cooling film to cool the exterior of the platform 34.

Passages 100 according to the present disclosure may thus advantageously cool the pressure side slash face 72 and proximate portions of a platform 34 of a bucket assembly 30. Such passages 100 provide a novel approach to cooling a platform 34 that prevents the pressure side slash face 72 and proximate portions from reaching undesirably hot temperatures. Additionally, in some embodiments, the configuration of such passages 100 according to the present disclosure advantageously increases the cooling efficiency of the cooling medium flowing through the bucket assembly 30, and thus requires minimal or no additional cooling medium for such cooling of the pressure side slash face 72 of a platform 34.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bucket assembly for a turbine system, comprising:

a main body having an exterior surface and defining a main cooling circuit;

a platform surrounding the main body and at least partially defining a platform cooling circuit, the platform comprising a forward portion and an aft portion each extending between a pressure side slash face and a suction side slash face and further comprising a forward face, an aft face, and a top face; and a passage defined in the platform generally between the platform cooling circuit and the pressure side slash face and adjacent to the pressure side slash face, the passage in fluid communication with one of the main cooling circuit or the platform cooling circuit.

2. The bucket assembly of claim 1, further comprising an impingement passage extending between and providing the fluid communication between the passage and the one of the main cooling circuit or the platform cooling circuit.

3. The bucket assembly of claim 1, wherein the passage is in fluid communication with the platform cooling circuit and the main cooling circuit.

4. The bucket assembly of claim 3, wherein an inlet of the passage is in fluid communication with the platform cooling circuit and an outlet of the passage is in fluid communication with the main cooling circuit.

5. The bucket assembly of claim 1, wherein the passage extends generally parallel to the pressure side slash face.

6. The bucket assembly of claim 1, further comprising an exhaust passage defined in the platform and in fluid communication with the passage.

7. The bucket assembly of claim 6, wherein an outlet of the exhaust passage is defined in the top face of the platform.

8. The bucket assembly of claim 6, wherein an outlet of the exhaust passage is defined in the suction side slash face of the platform.

9. The bucket assembly of claim 6, further comprising a plurality of exhaust passages.

10. The bucket assembly of claim 1, wherein the main body comprises an airfoil and a shank, the airfoil positioned radially outward from the shank.

11. A turbine system, comprising:

a compressor;

a turbine coupled to the compressor; and a plurality of bucket assemblies disposed in at least one of the compressor or the turbine, at least one of the bucket assemblies comprising:

a main body having an exterior surface and defining a main cooling circuit;

a platform surrounding the main body and at least partially defining a platform cooling circuit, the platform comprising a forward portion and an aft portion each extending between a pressure side slash face and a suction side slash face and further comprising a forward face, an aft face, and a top face; and a passage defined in the platform generally between the platform cooling circuit and the pressure side slash face and adjacent to the pressure side slash face, the passage in fluid communication with one of the main cooling circuit or the platform cooling circuit.

12. The turbine system of claim 11, further comprising an impingement passage extending between and providing the fluid communication between the passage and the one of the main cooling circuit or the platform cooling circuit.

13. The turbine system of claim 11, wherein the passage is in fluid communication with the platform cooling circuit and the main cooling circuit.

14. The turbine system of claim 13, wherein an inlet of the passage is in fluid communication with the platform cooling circuit and an outlet of the passage is in fluid communication with the main cooling circuit.

15. The turbine system of claim 11, wherein the passage extends generally parallel to the pressure side slash face.

16. The turbine system of claim 11, further comprising an exhaust passage defined in the platform and in fluid communication with the passage.

17. The turbine system of claim 16, wherein an outlet of the exhaust passage is defined in the top face of the platform.

18. The turbine system of claim 16, wherein an outlet of the exhaust passage is defined in the suction side slash face of the platform.

19. The turbine system of claim 16, further comprising a plurality of exhaust passages.

20. The turbine system of claim 11, wherein the main body comprises an airfoil and a shank, the airfoil positioned radially outward from the shank.

* * * * *